US006231203B1

(12) United States Patent
Olshausen

(10) Patent No.: US 6,231,203 B1
(45) Date of Patent: May 15, 2001

(54) SELF-EXTINGUISHING, FLUSH-HANDLE, NIGHT-LIGHT

(76) Inventor: Michael Cohnitz Olshausen, P.O. Box 2075, Bristol, PA (US) 19007

( * ) Notice: Subject to any disclaimer, the term of this patent is extended or adjusted under 35 U.S.C. 154(b) by 0 days.

(21) Appl. No.: 09/238,764

(22) Filed: Jan. 28, 1999

(51) Int. Cl.[7] ..... A47K 17/00

(52) U.S. Cl. ..... 362/101; 362/156; 362/394; 4/661

(58) Field of Search ..... 362/101, 156, 362/394; 4/661

(56) References Cited

U.S. PATENT DOCUMENTS 5,276,595 * 1/1994 Patrie ..... 362/101

5,926,867 * 7/1999 Buchanan ..... 4/661

* cited by examiner

*Primary Examiner*—Sandra O'Shea
*Assistant Examiner*—Anabel M Ton

(57) ABSTRACT

A night-light adapted to illuminate a toilet bowl and located in the toilet's flush-handle. The light shuts off automatically and remains unobtrusive and clean during use. A semiconductor circuit built into the flush-handle extinguishes the light after a certain length of time. Powered by a lithium battery, the light will yield many hundreds of illuminations before battery replacement or whole-unit replacement become necessary. The device is substantially the same size and shape as conventional flush handles.

33 Claims, 8 Drawing Sheets

SELF-EXTINGUISHING, FLUSH-HANDLE, NIGHT-LIGHT

BACKGROUND OF THE INVENTION

This invention relates to night-lights for use in bathrooms, and more specifically to small, low-luminosity lights adapted to illuminate the toilet bowl and adjacent areas. Many, commercially-available, night-lights contain small, neon bulbs that emit a substantially orange light. Many other night-lights contain small, incandescent bulbs, such as are used in Christmas tree lighting. Nearly all such night-lights plug directly into a wall-mounted electrical outlet. It is commonly the case, however therein adequately illuminates the bathroom's toilet bowl. And thus arises, so to speak in mid-stream, the "male aiming problem", which, during the night, is aggravated by the desire not to turn on a brilliant light. An attempt is often made to make do with the poor illumination, or with the poorly-placed illumination, provided by customary night-lights, with the consequence, sometimes unnoticed until the morning, of splatter. Small children, who cannot reach the bathroom-wall switch, often leave behind similar "mistakes." Wives and mothers generally do not find any of this endearing.

Many night-lights intended to illuminate a conventional toilet bowl have been patented. U.S. Pat. Nos. 5,136,476 and 5,150,962 and 5,513,397 all disclose devices which have in common their engagement with the toilet-bowl rim, using it as a support. These devices, though they illuminate the bowl well, share the disadvantage of being located, so to speak, next to the flight-path, and will soon show signs of buildup-soiling. Because they do not have many plane surfaces, and may not be glossy, they will be harder to keep clean than the toilet-bowl rim itself.

U.S. Pat. No. 4,413,364, discloses a device located at the rear of the toilet bowl, rather than along the bowl's side, and thus shares the same soiling problem.

U.S. Pat. Nos. 4,860,178 and 5,263,209 and 5,664,867 disclose devices intended to be mounted on the bottom, toroidal member of a conventional toilet seat, and in fact substantially, if not entirely, on the bottom surface thereof. Somewhat more slowly, perhaps, but with equal certainly, these devices will soil. They will be harder to keep clean than the toilet seat itself, especially around seams and lines of contact.

U.S. Pat. Nos. 4,736,471 and 5,276,595 disclose devices intended to be mounted to the under-side of the lid of a toilet seat. Although these devices will soil much-less readily than the devices discussed so far, they cannot be terribly comfortable to lean back against, as when reading the sports pages or the funnies, two happy bathroom pastimes.

U.S. Pat. Nos. 3,982,288 and 5,611,089 disclose devices which cleverly embed their lighting elements within a clear, or transparent material used to fabricate the bottom member of a toilet seat. Apart from the possibility that these devices may shed somewhat more light on the subject, particularly afterwards, than is exactly wanted, they will be relatively expensive to make and, thus, to purchase. U.S. Pat. No. 5,611,089 furthermore places its switch and power pack in the hinge area of the toilet seat, a location quite exposed to the aforesaid "male aiming problem".

U.S. Pat. No. 5,748,096 discloses a device which audibly prompts the user to return the toilet seat to the horizontal position in order to turn off the illumination. This seems a rather fussy and intrusive, not to say imperious, device to have in a bathroom, and with which to be greeted, when all that one wants to do is to attend to a midnight urgency. The device furthermore requires a sensor to detect the position of the seat, which sensor is shown to be a switch that must be mounted with respect to the seat and bowl so that the one or the other holds it. This device will soil rather quickly.

Common to all of the devices discussed above is a switch-mechanism which requires some sort of action on the part of the user to ensure that the toilet illumination is switched off. Common as well is close proximity to the toilet bowl, the aforesaid devices never being father from it than the underside of the toilet-seat lid. All of these positions invite soiling, and do not particularly invite touching.

It is the object of the present invention to provide a bathroom night-light that does not entail any of these drawbacks.

BRIEF SUMMARY OF THE INVENTION

The present invention locates the light source in the one component of a conventional toilet that every user basically has to touch, namely the flush handle. Furthermore, the present invention shuts off the source of light automatically. After the user has turned on the illumination, no subsequent action is required of him to turn it off—he can go sleepily back to bed.

In the preferred embodiment of the present invention, this automatic function is accomplished by means of a semiconductor circuit containing an N-channel, power MOSFET and a lithium battery. The duration of the illumination could, of course, be made adjustable by means of a mini-potentiometer, but is probably best left fixed at around 75 seconds or so. The power drain resulting from one use is so insubstantial that many hundreds of uses will intervene before the battery must be replaced. It is envisioned, in any case, that the handle assembly itself will be made easily and simply replaceable—whole unit replacement—and, hopefully, recyclable.

U.S. Pat. No. 2,475,881 discloses a means for decorating the flush handle of a toilet, but does not disclose a handle containing electronic components of any sort. U.S. Pat. No. 5,117,513 discloses a flush handle with an internal mechanism with which to control the amount of water released on each use, but this mechanism is mechanical and does not contain electronic components of any type.

With the foregoing in mind, it is an important object of the present invention to provide a simple, inexpensive, night-light, particularly adapted to illuminating a toilet bowl, which is neither fussy nor intrusive, and which requires no action on the part of the user in order to shut off.

It is yet another object of the present invention to provide an approximate, softened, lighting of the toilet-bowl area, as may be formed by a combination of direct, reflected, and scattered illumination, rather than lighting which is aimed and thus may be a bit harsh and/or concentrated.

It is yet another object of the present invention to preserve the dark adaption of the user and to intrude as little as possible on his sleepy state.

It is yet another object of the present invention to remain clean while in use, and to be easily cleaned.

It is still another object of the present invention to be relatively simple to manufacture from standard components, using standard methods, among them injection molding.

The above and still further objects and advantages of the present invention will become apparent from a consideration of the following detailed specification, drawings, and appended claims.

BRIEF DESCRIPTION OF THE SEVERAL VIEWS OF THE DRAWING

Referring to the drawings, wherein like reference characters indicate like parts or elements throughout the several views.

DETAILED DESCRIPTION OF THE INVENTION

Figure 1:
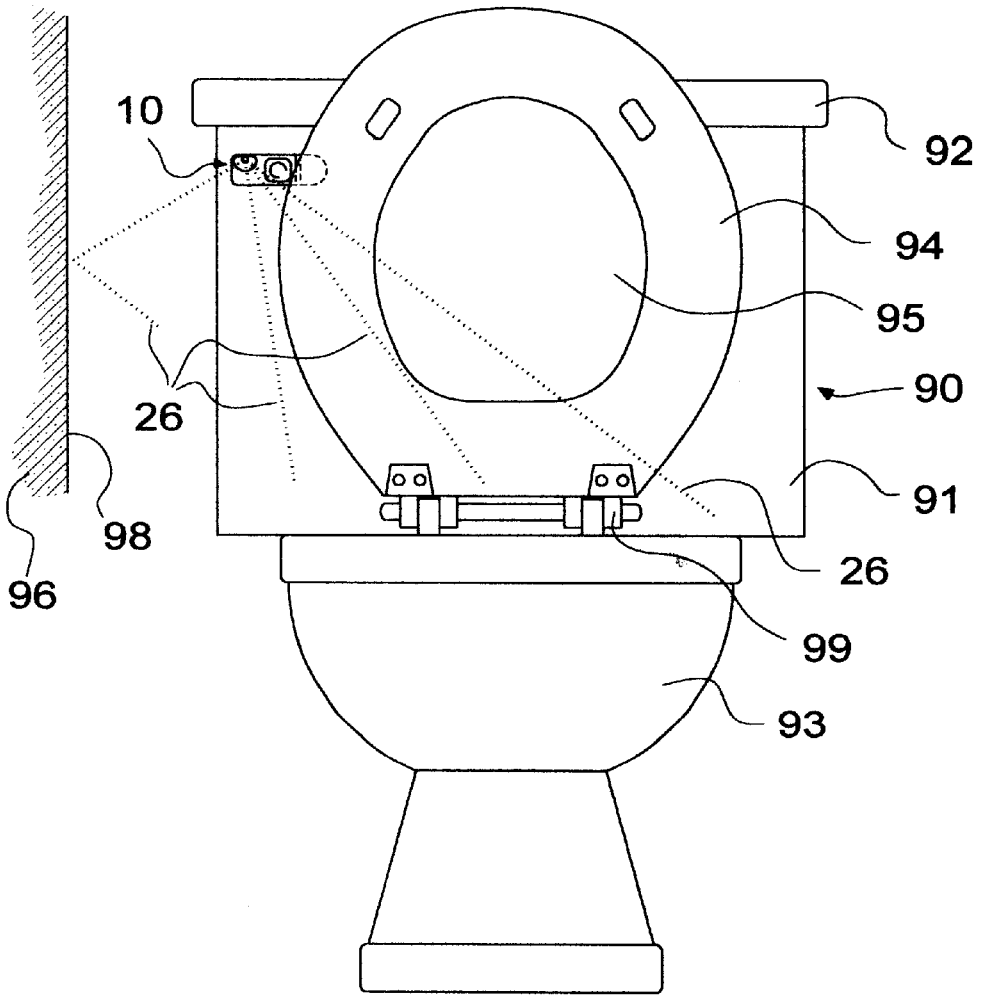
FIG. 1 is a front, plan view of a conventional toilet next to a generic object.

FIG. 1 shows conventional toilet 90, having toilet bowl 93, water tank 91, and tank lid 92. To toilet 90 is attached a conventional toilet seat having bottom seat member 94, top seat member 95, seen here through the opening in bottom seat member 94, and hinge 99. Flush handle 10 is attached to toilet 90 in the conventional position, namely the left-hand upper corner of tank 91. As in most bathrooms, some object 96, possibly a cabinet, possibly just a wall, with surface 98, is shown in the immediate vicinity of toilet 90. Emanating from flush handle 10 are light rays 26, of which there are an infinite number. The light rays depicted in FIG. 1 fan out over the toilet bowl 93, and reflect back from surface 98 in the direction of the bowl.

Figure 2:
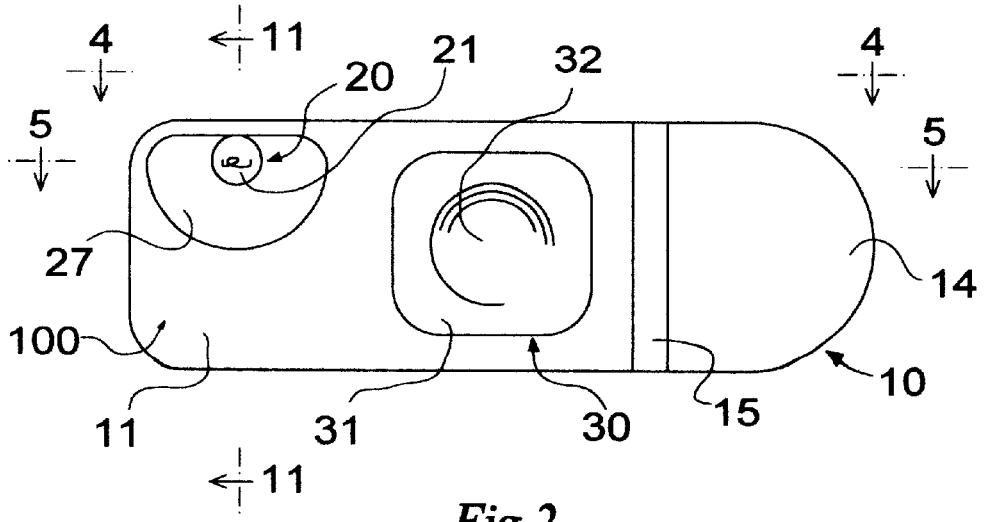
FIG. 2 is a front, plan view of the preferred embodiment the present invention

FIG. 2 shows flush handle 10 in greater detail, showing housing 100, light-emitting element 20, and membrane switch 30. Light-emitting element 20 is shown to be a low-voltage, incandescent bulb, having filament 21. Light-emitting element 20 is further shown located in the upper, left-hand corner of housing 100, set into an indentation in housing 100, which indentation is first fully described in FIG. 5. Covering light-emitting element 20 and hence sealing the indentation is transparent window 27.

Affixed to first, flat, front surface 11 of housing 100 is membrane switch 30 having top surface 31. Top surface 31 of membrane switch 30 further has a raised, or domed, central portion 32, which facilitates tactile location of switch 30 in the dark.

Housing 100 is further shown to have two, other surfaces, namely first, front, flat surface 11 and surface 15, which connects surface 11 to second, front, flat surface 14. These surfaces are more fully documented in FIGS. 4 and 5.

Figure 3:
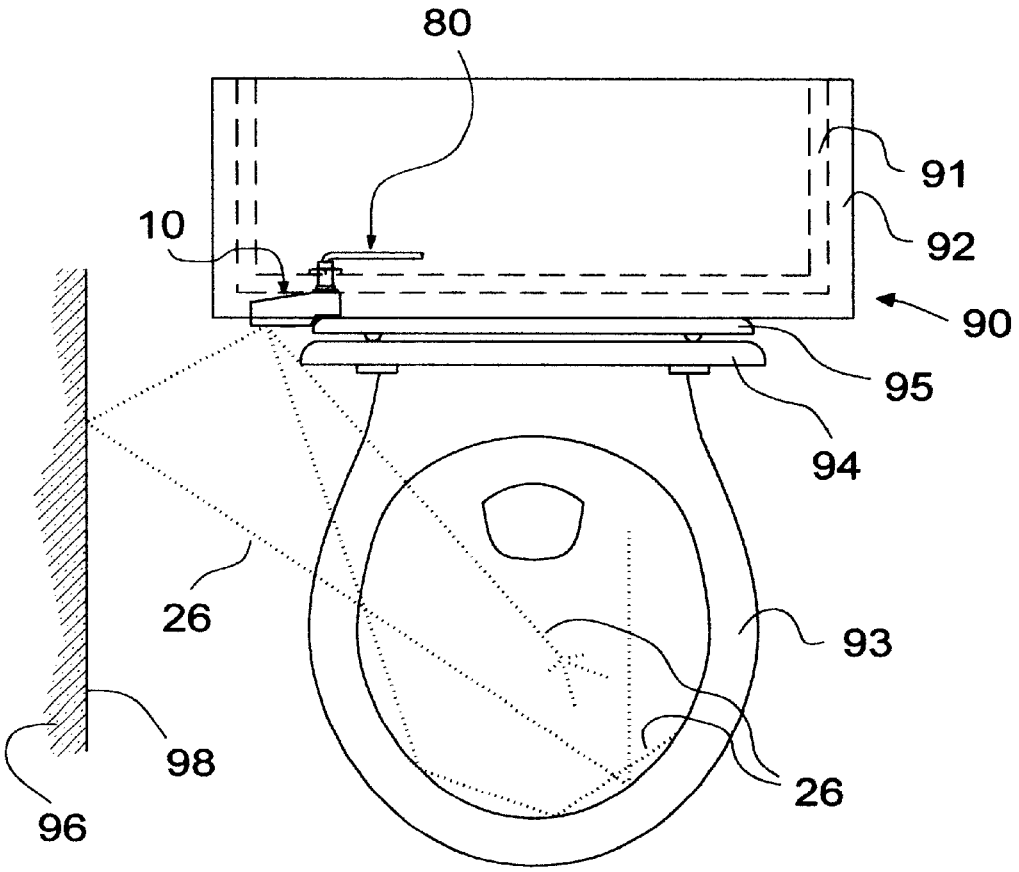
FIG. 3 is a top, plan view of the toilet shown in FIG. 1. next to a generic object.

FIG. 3 shows toilet 90 and light rays 26 emanating from flush handle 10. Light rays 26 fan out over bowl 93, reflecting off its glossy, oval rim. Other light rays scatter in the water within bowl 93, while yet others reflect off surface 98 of nearby object 96. The resulting illumination of bowl 93, in actual practice, is softened and not harsh.

Flush handle 10 is shown connected to conventional lift-arm 80, by means of which flush handle 10, being caused to rotate through a small angle by the person using toilet 90, causes in turn the internal mechanism of toilet 90 to release water into bowl 93. Lift arm 80 passes through an aperture in tank 91, and is secured to the tank by a spud and nut. These toilet components are first fully documented in FIGS. 6 through 9.

FIG. 3 further shows flush handle 10 in relation to top seat member 95, and bottom member 94 of a conventional toilet seat, after both of these members have been raised and leaned back against tank lid 92. In this top, plan view, the proximity of flush lever 10 to lid 95 seems somewhat closer than it actually is, for top member 95 generally is round and thus curves inward toward its top. Top member 95 merely appears in FIG. 3 as if it were maximally wide at the point at which it is nearest to flush handle 10.

Figure 4:
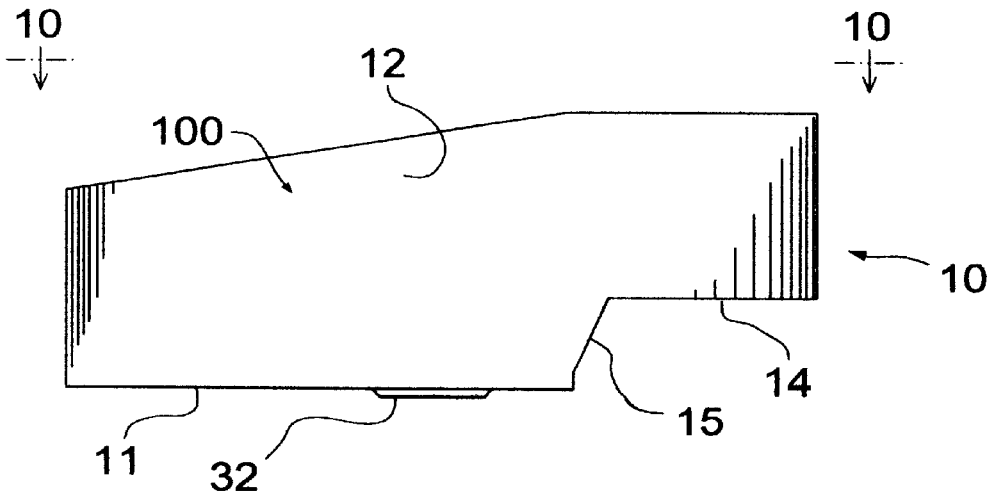
FIG. 4 is a top, plan view of the preferred embodiment of the present invention

A "universal" model of flush handle 10, in contrast to a dedicated model, will have to accommodate even the largest of standard toilet seats mounted on the smallest of standard tanks, and especially to accommodate such seats during rotation of flush handle 10. Housing 100 will thus need to be recessed over its point of rotation, which is the point where lift arm 80 joins housing 100. FIG. 4 shows flush handle 10 from above, and, in particular, shows this recessed form of housing 100. Front flat surface 14 is shown recessed, or set back from, and parallel to, front, flat surface 11, to which it is joined by substantially oblique surface 15. Top surface 12 of housing 100 is shown flat over most of its length, with decorative rounding at its long ends.

Figure 5:
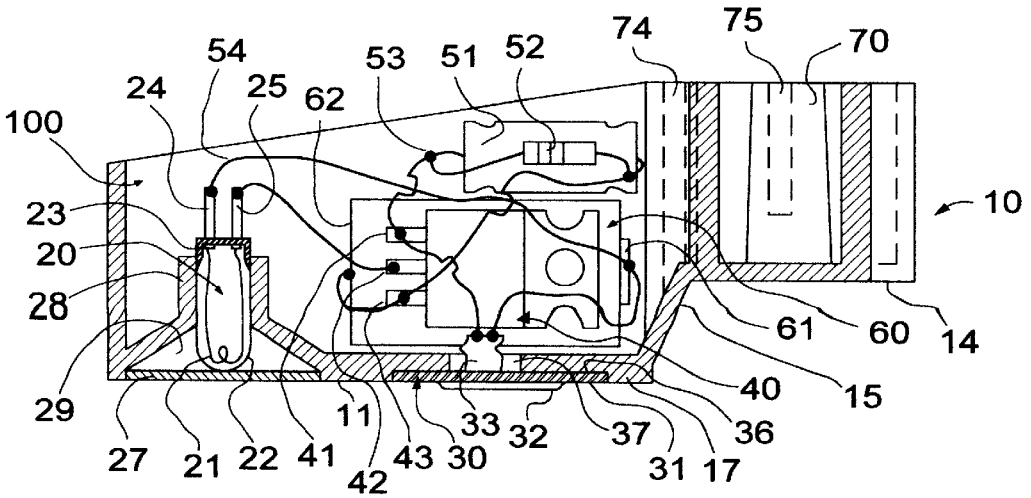
FIG. 5 is a sectional view of the preferred embodiment of the present invention taken through line 5—5 of FIG. 2

FIG. 5 is a sectional view of housing 100 showing the electrical circuit and components thereof contained within. Light-emitting element 20 has glass bulb 22 attached to base 23, from which protrude pins 24 and 25 by means of which electrical energy, namely an electric current, is conducted through filament 21, which will thereupon emit light, provided the voltage and amperage of the current are suited to the composition of filament 21. Light-emitting element 20 is located in an indentation in front, flat surface 11 of front wall 17 of housing 100, which indentation is formed by light-emitting-element holder 28. Holder 28 is shown to be an integral part of housing 100, housing 100 being in practice a molded part, and is, in its form and its exterior surface 29, substantially conical. Covering the indentation formed in surface 11 by holder 28 is transparent window 27. Window 27 protects light-emitting element 20 and also allows surface 11 to be easily cleaned.

Also contained within housing 100 are lithium battery 60, having positive terminal 61 and negative terminal 62, resistor 52, electrolytic capacitor 51, and N-channel power MOSFET (Metal Oxide Semiconductor Field Effect Transistor) 40. MOSFET 40 has gate 41, drain 42, and source 43. Joining these electrical components into a circuit are generic wires 54 and generic solder joints 53. Battery 60 is shown permanently connected to the 1 other electrical components, that is hardwired into the circuit. It is this circuit that is the means whereby light-emitting element 20 automatically is made to cease emitting light after a period of time after it has intentionally been lit.

Figure 17:
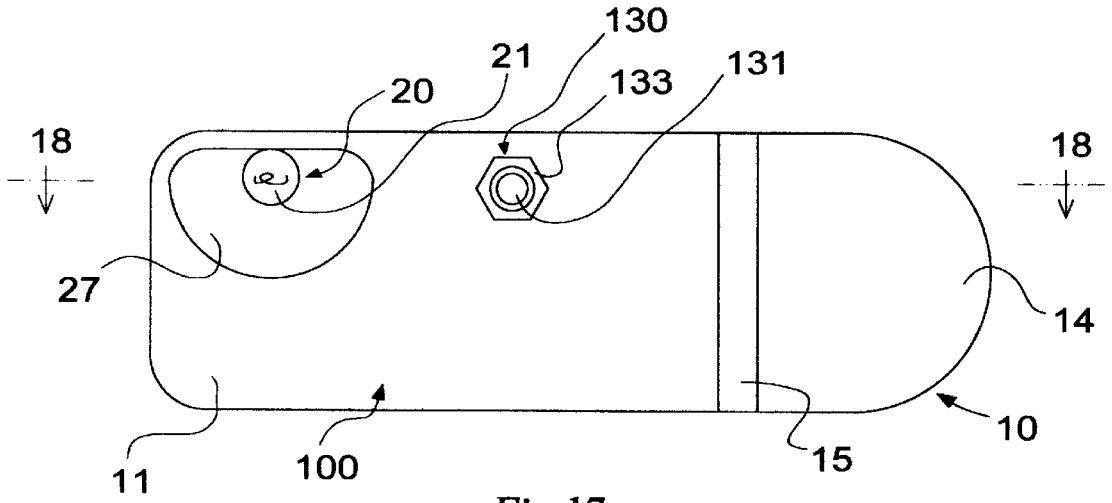
FIG. 17 is a front plan view of a fourth embodiment of the present invention.
Figure 18:
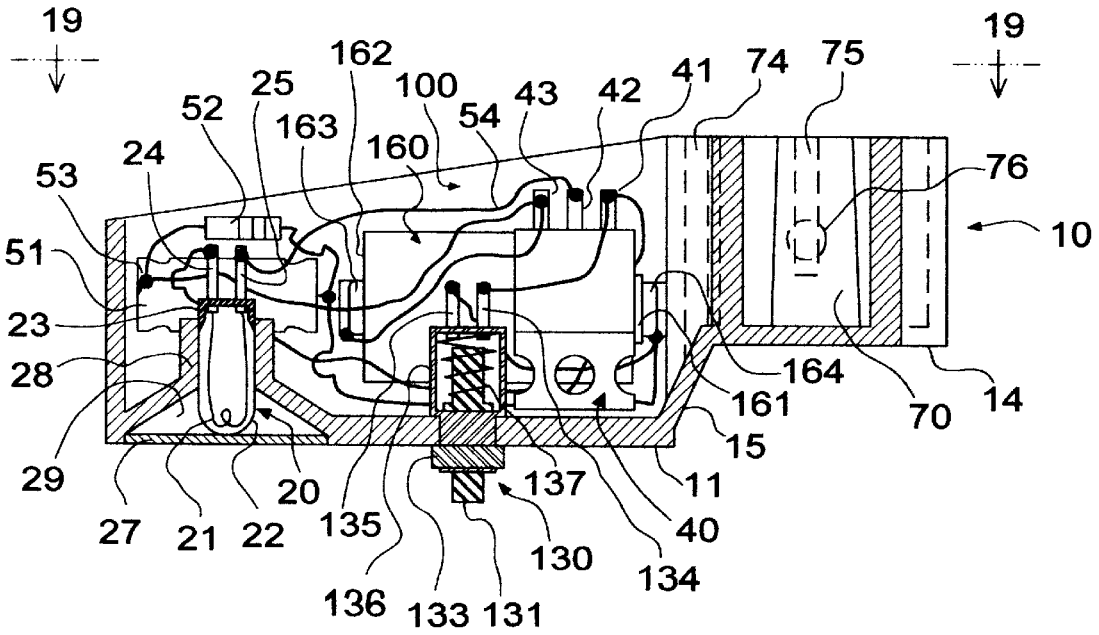
FIG. 18. is a sectional view of the embodiment of the present invention shown in FIG. 17, taken through line 18—18 of FIG. 17.
Figure 19:
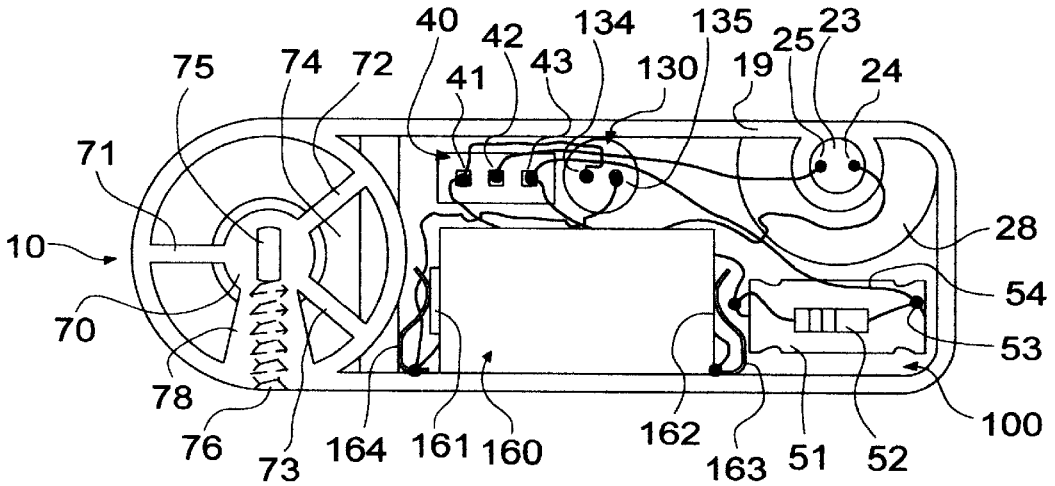
FIG. 19 is a rear plan view of the embodiment shown in FIG. 18, taken through the line 19—19 of FIG. 18.

Set into a recess of wall 17 is simple membrane switch 30, 14 which is the functional, but planar, equivalent of the more-ordinary and lengthy, normally-open, push-button switch (FIGS. 17 through 19 disclose an embodiment of the present invention employing this more-ordinary switch). Membrane switch 30 has rear, adhesive surface 36 with which it is held into its recess in wall 17. Flexible, planar lead-tail 33 enters the interior of housing 100 by passing through aperture 37 in front wall 17. When a person presses raised portion 32 of the front surface 31 of membrane switch 30, the normally-open state of the planar contacts within the switch momentarily changes to closed, and the electrical circuit within housing 100 is thereby activated. A person's initiating action, namely of briefly tapping switch 30, is all that is required to cause light-emitting element 20 to emit light and, after a period of time, for light-emitting element 20 to cease to emit light. No subsequent action is required of the person to turn off the light.

At the long end of housing 100 opposite to the end at which light-emitting element 20 has been located is a means for engaging lift-arm 80. This engagement means comprises a central post 70 with a socket 75 shaped to mate snugly with lift-arm 80, as will be described in detail presently. Rotation socket 74 acts to limit rotation of flush handle 10, as will be described in detail presently.

Figure 6:
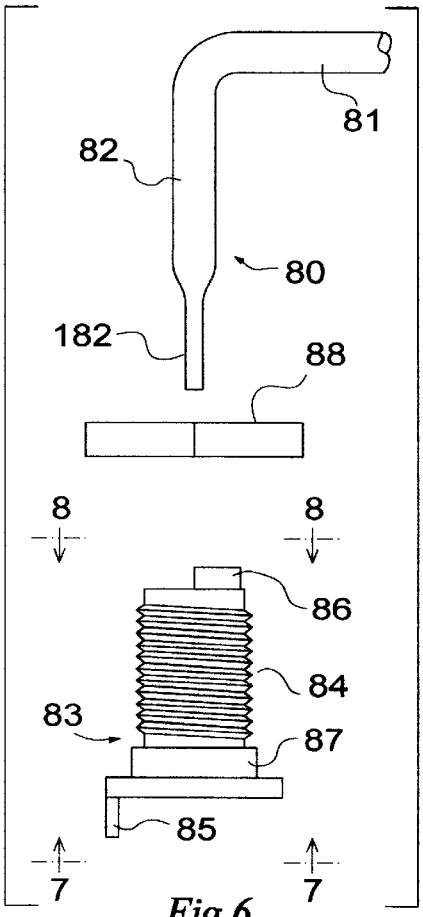
FIG. 6 is a side plan view of the three interior components of a conventional toilet by means of which the present invention may be connected to such a toilet, thereby to become, itself, a component part thereof.

FIG. 6 shows lift-arm 80, spud 83, and hex nut 88, which together are the conventional components of conventional toilet 90 enabling an ordinary flush handle to, by rotation through a small angle, cause water to drain rapidly from tank 91 into bowl 93. Flush handle 10 operates, in other than its electrical aspect, in conventional fashion. Lift-arm 80 is bent such that the longer portion 81 of it lies substantially parallel to the long, horizontal dimension of tank 91. Shorter portion 82 is substantially perpendicular to portion 81 and further has a flattened end 182 which is inserted into socket 75 of housing 100 of the present invention. Spud 83 passes through a generally square aperture in tank 91, and has left-hand threaded barrel 84, square shelf 87, rotation finger 85, and lift-arm, rotation finger 86.

Figure 7:
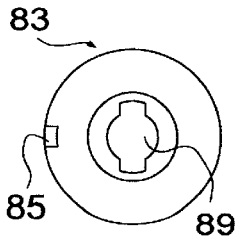
FIG. 7 is a bottom, plan view of one of the components shown in FIG. 6 taken through line 7—7 of FIG. 6.

FIG. 7 shows the end of spud 83 proximate to flush handle 10. Lift-arm 80 passes through aperture 89 in spud 83, which aperture is sufficiently circular to allow portion 82 of lift-arm 80 to rotate within it, and sufficiently elongated along one axis to allow flattened portion 182 of lift-arm 80 to pass through it in order to mate with socket 75. Spud 83 is so installed in tank 91 that rotation finger 85 lies at the left end of the horizontal axis of spud 83 as depicted in FIG. 7. Rotation finger 85 will thus be inserted into rotation socket 74 of housing 100.

Figure 8:
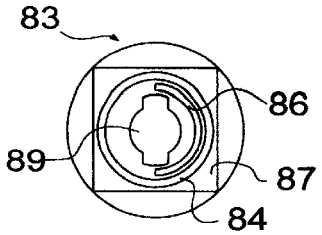
FIG. 8 is a top plan view of the same, component shown in FIG. 7, taken through line 8—8 of FIG. 6.

FIG. 8 shows the end of spud 83 distal to flush handle 10, and in particular shows square shelf 87 which, by residing in a generally-square aperture in tank 91 prevents spud 83 from rotating. Lift-arm rotation finger 86, which may at times come into contact with portion 81 of lift arm 80, minimizes any frictional drag on lift-arm 80 when flush handle 10 is rotated, thus facilitating the smooth working of the complete flush mechanism.

Figure 9:
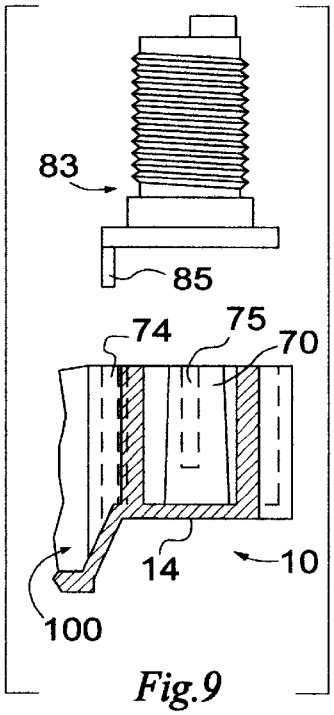
FIG. 9 is a partial, sectional view of the preferred embodiment of the present invention, sectioned as in FIG. 5, shown in vertical registry with the interior, toilet component isolated from FIG. 6 by FIGS. 7 and 8.

FIG. 9 shows housing 100 in its proper, axial relation to spud 83. The axis of rotation of flush handle 10 is portion 82 of lift-arm 80, and the point of rotation may thus be said to lie beneath set-back, front, flat surface 14 of housing 100.

Figure 10:
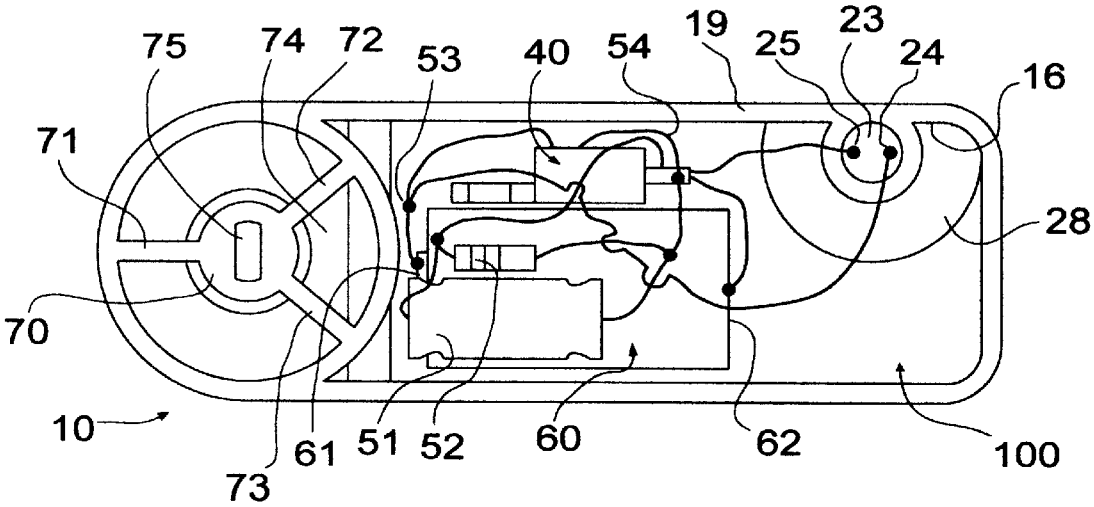
FIG. 10 is a rear, plan view of the preferred embodiment of the present invention taken through line 10—10 of FIG. 4.

FIG. 10 shows housing 100 of FIG. 5 but now from the rear and with the same components as shown in FIG. 5 and in their same relative positions. The substantially conical shape of holder 28 is once again apparent, and indeed interior surface 16 of top wall 19 of housing 100 is seen to cut off the cone at the point where the plane of surface 16 is tangent to the base 23 of light-emitting element 20.

Housing 100 may be mated to flattened end 182 of lift arm 80 by press-fitting end 182 into socket 75 of central post 70. Central post 70 is stabilized within housing 100 by means of ribs 71, 72, and 73, which transmit torque to central post 70 and, thereby, to lift-arm 80. The gap 74 between ribs 72 and 73 is the rotation socket 74, in which rotation finger 85 of spud 83 resides. The rotation of flush handle 10 about its rotational axis, as defined by portion 82 of lift-arm 80, is limited in angle by the contact of finger 85 with ribs 72 and 73. Some slight rotational jiggling of flush handle 10 is generally possible before the release of water actually takes place from tank 91 into bowl 93.

Figure 11:
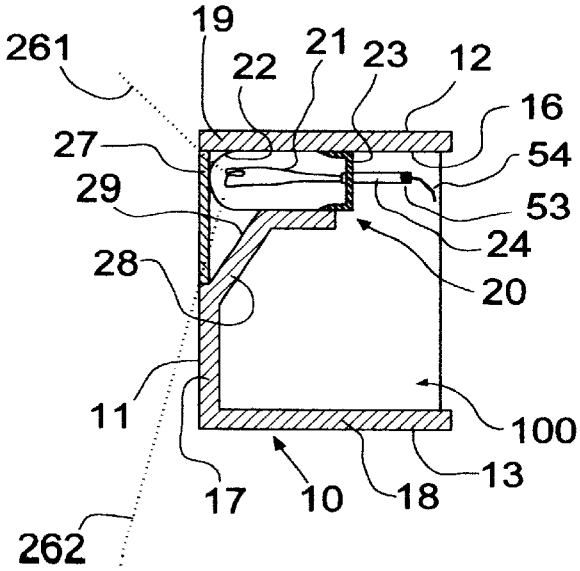
FIG. 11 is a sectional view of the preferred embodiment of the present invention taken through line 11—11 of FIG. 2.

FIG. 11 shows the relationship of filament 21 of light-emitting element 20 to housing 100, light-emitting-element holder 28, and window 27. Because inner surface 16 of top wall 19 of housing 100 meets front surface 11 of front wall 17 perpendicularly and at a point as close as possible to filament 21, light ray 261 emanating from filament 21 is limited to about 45° or so in its upward angle. By contrast, the conical form of surface 29 of light-emitting-element holder 28 allows light ray 262 to shine down at a much steeper angle, shown here to be about 75°. The practical effect of these limitations is, on the one hand, to prevent light from shining up into the eyes of the user, who will be rather sleepy, but to allow bowl 93 of toilet 90 to be well illuminated.

Housing 100 is further shown to have bottom surface 13 of bottom wall 18.

Figure 12:
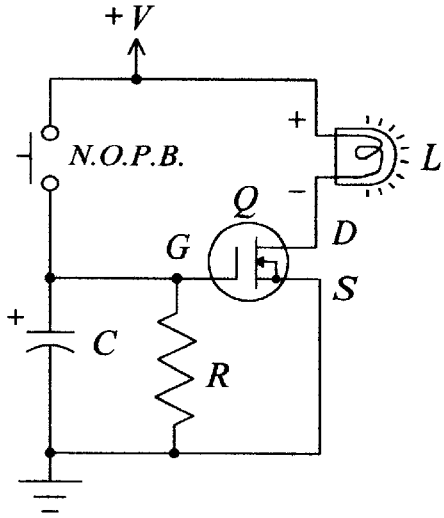
FIG. 12 is the electrical circuit of the preferred embodiment of the present invention depicted by means of standard, electrical symbols.

FIG. 12 is a diagram of the circuit illustrated in FIGS. 5 and FIG. 10 drawn with standard, electrical symbols. It will be noted that the type of electrolytic capacitor C shown in FIG. 12 is polarized, whereas the type of electrolytic capacitor shown in of FIGS. 5 and FIG. 10 is unpolarized. Either type will work. However, should the polarized variety be used, then the polarity must be oriented as shown in FIG. 12.

It has been found experimentally that an on-time of about 85 seconds is achieved by employing a 6 volt lithium battery V, a 4.7 microfarad electrolytic capacitor C, a 62 megohm resistor R, a 60-volt N-channel, power MOSFET Q, and a 6 volt 0.025 amp an incandescent bulb L in the circuit. If the battery has a useful life of 160 milliamp hours, then the number of uses in the circuit just described is about $$271(=(160\text{mAh}/25\text{mA})\times(3600\text{sec}/85\text{sec}),$$

disregarding the negligible current drain from power MOSFET Q. If resistor R is replaced by a somewhat lower-rated resistor, the on-time may be decreased to any desired number of seconds. An on-time of 1 minute will yield 384 uses, or more than a year's worth, if the device is used daily. A battery with a useful life of 600 mAh will increase the number of uses to over 1000, even at 85 seconds per use.

Trials have indicated that a somewhat more complicated circuit, particularly one employing the 555 timer chip, are sometimes over-sensitive to jiggling. That is, the light may simply turn on by itself when toilet 90 is flushed, during the daytime for example, which is undesirable. Timer chip 555 does not, therefore, appear well suited to this application.

Figure 13:
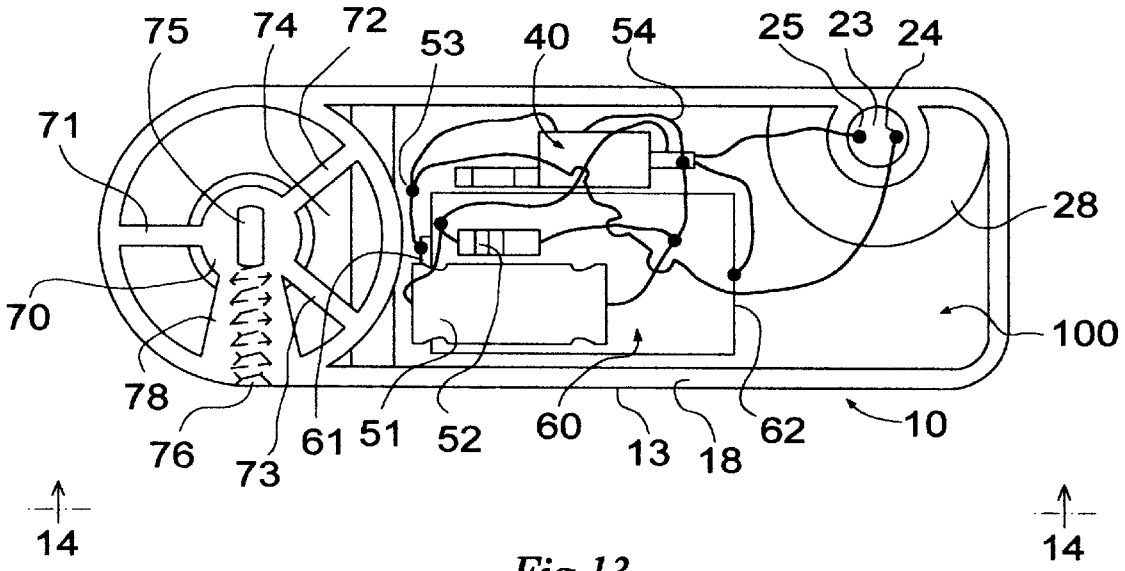
FIG. 13 is a rear, plan view of a second embodiment of the present invention, taken as FIG. 10.

FIG. 13 discloses a second embodiment of the present invention identical in all respects to the first, except that now housing 100 may be reversibly mounted on lift-arm 80. This is accomplished by adding rib 78 to housing 100, where rib 78 is sufficiently wide to allow for the provision of threaded bore 76. A set screw may now be installed in bore 76 and used to mate housing 100 reversibly to flattened end 182 of lift arm 80. Bore 76 extends through bottom surface 13 of bottom wall 18.

Figure 14:
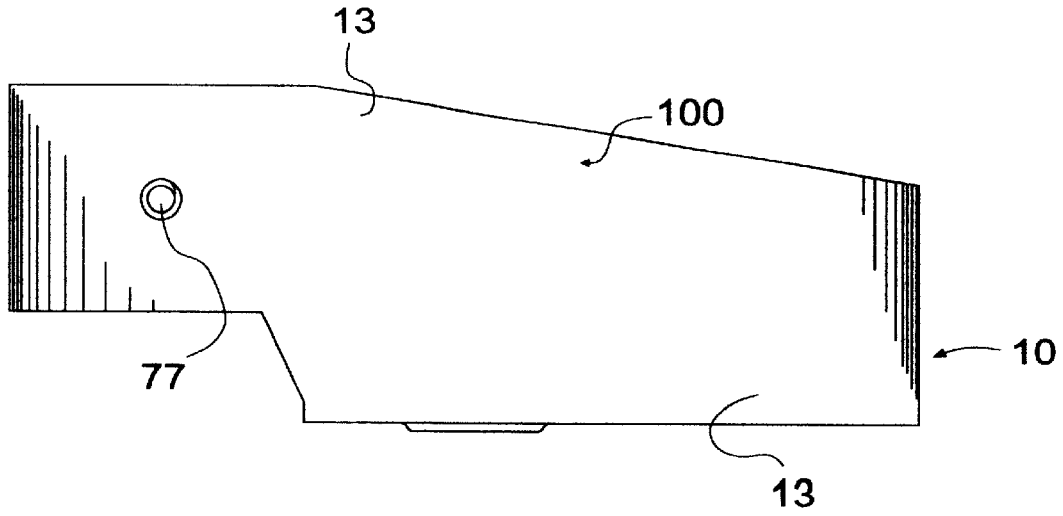
FIG. 14 is a bottom, plan view of the embodiment shown in FIG. 13 taken through line 14—14 of FIG. 13.

FIG. 14 shows hole 77 in bottom surface 13 of housing 100. Hole 77 is where threaded bore 76 pierces bottom surface 13 of bottom wall 18.

Figure 15:
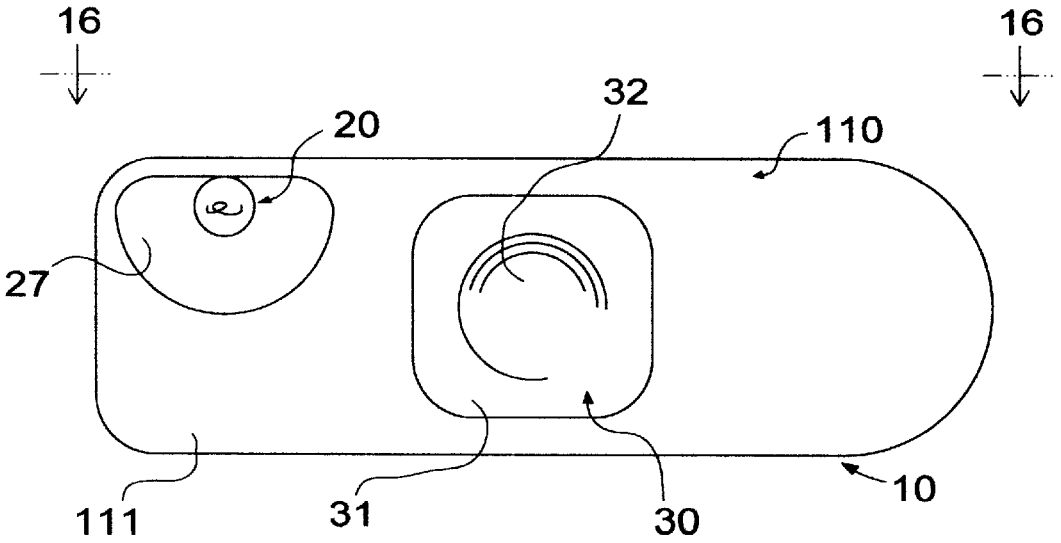
FIG. 15 is a front, plan view of a third embodiment of the present invention.

FIG. 15 shows a third embodiment of the present invention, in which the form of the housing has been simplified. Alternate housing 110 has a single, flat, front surface 111 which is not set back over the axis of rotation defined by lift arm portion 82, as described above. The advantage of housing 110 is primarily aesthetic, in that it adopts a minimalist approach to design. The disadvantage of housing 110 is that it may come into contact with top toilet-seat member 95, in some instances.

Figure 16:
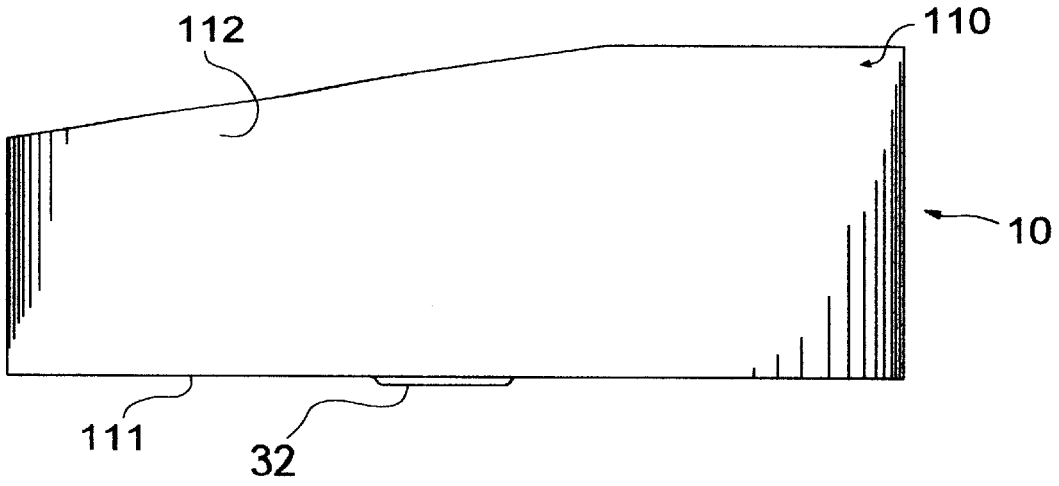
FIG. 16 is a bottom, plan view of the embodiment of the present invention shown in FIG. 15 taken through line 16—16 of FIG. 15.

FIG. 16 shows the alternate embodiment of the invention disclosed in FIG. 15, but as seen from above, in order further to illustrate flat, front surface 111. Ribs 71, 72, and 73 and center post 70 of the embodiment of the invention disclosed in FIGS. 2, 4, 5, and 10 must merely be extended forward. Building a mold for housing 110 would both be somewhat-easier, and therefore somewhat-less expensive, than building a mold for housing 100.

FIG. 17 shows a forth embodiment of the present invention, identical in nearly all respects to the embodiment disclosed in FIGS. 2, 4, 5, and 10, except that membrane switch 30 has been replaced by conventional push-button switch 130, and battery 60 has been made removable. Hex-nut 133 attaches push-button switch 130 to housing 100. The disadvantage of conventional push-button switch 130 is its high, internal, space requirement, which membrane switch 30 eliminates. As will presently be seen in FIGS. 18 and 19, push-button switch 130 is best located well above the center line of housing 100.

FIG. 18 is a sectional view of the embodiment disclosed in FIG. 17, showing the internal, electrical components rearranged in order to gain sufficient, interior space both to make battery 160 removable, and thus replaceable, and to accommodate barrel 136 of push-button switch 130. Switch 130 has contacts 134 and 135. Battery 160, with positive terminal 161 and negative terminal 162, instead of being hardwired into the circuit, as before, is now held in position by battery clips 163 and 164, which hold battery 160 by their joint, and opposite, spring tension. In such tight quarters as housing 100, there is essentially no other position for battery 160, if it is to store sufficient electrical energy to power the light-emitting element 20 over many, repeat uses and to be easily removable. Since FIG. 18 is a sectional rendition, we show internal spring 137 of push-button switch 130 for completeness sake.

FIG. 19 shows the embodiment disclosed in FIG. 18 from the rear, the better to illustrate battery clips 163 and 164 and the location of push-button switch 130. Since, to remove and replace battery 160 will be accomplished most easily by disengaging housing 100 from lift arm 80, this embodiment of the present invention is also provided with threaded bore 76 for the insertion of a set screw, as described above.

Figure 20:
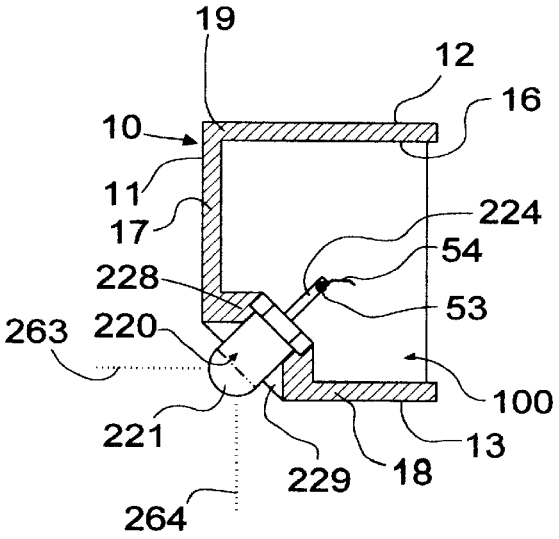
FIG. 20 is a sectional view, taken in the manner of FIG. 11., of a fifth embodiment of the present invention.

FIG. 20 discloses a fifth embodiment of the present invention, in which a wide-angle, light-emitting diode, LED 220, has been introduced as the light-emitting element, in place of incandescent bulb 20. This substitution necessitates reconfiguring and repositioning light-emitting-element holder 28. Alternate light-emitting-element holder 228 is now shown located at the lower, rather than the upper, far corner of housing 100. The indentation formed by light-emitting-element holder 228 involves both front wall 17 and bottom wall 18 of housing 100. Substantially-conical, light-emitting-element holder 228 is shown placed at a 450 angle with respect to wall 17 and 18, so that the axis of holder 228 passes through the line of intersection formed by front surface 11 and bottom surface 13. It would, of course, also be possible to employ the location of holder 228 for an incandescent bulb, as well.

Exterior surface 229 of light-emitting-element holder 228 acts primarily as a reflector, although, even from the wide-angle LED 220, relatively little radiation will actually strike surface 229 and be reflected from it. This is because the radiation pattern of LEDs is typically a narrow cone, rarely exceeding ±40° to the half-intensity point. Although the present invention is best served by a broader pattern, a fairly decent illumination pattern may still be achieved by directing LED 220 downward, toward bowl 93. Top-most light ray 263 and bottom-most light ray 264 describe the cone of useful light emitted by LED 220. Lens 221 of LED 220 concentrates the emitted light into this cone. Cathode pin 224 of LED 220 is shown soldered to generic wire 54. The anode pin (behind pin 224 in this view) is likewise soldered to another, generic wire, which wires thus join LED 220 to the electrical circuit.

Figure 21:
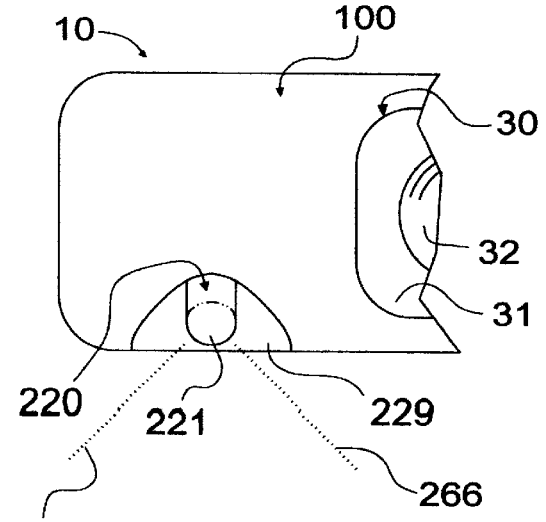
FIG. 21 is a partial, front plan view of the embodiment shown in FIG. 20.

FIG. 21 shows the bottom, far corner of housing 100, where alternate light-emitting-element holder 228 is located. Distance, in the present context, is measured relative to the axis of rotation of flush handle 10; hence the designation "far corner". Left-most light ray 265 and right-most light ray 266 once again define the useful cone of LED light.

It is possible actually to build an embodiment of the present invention using an LED, but the inventor does not particularly recommend it. The circuitry is necessarily more complex, because a regulator circuit must be incorporated, in order to supply a constant current to LED 220 as the voltage of battery 60 diminishes. Yet housing 100 offers very little room for such circuitry. Furthermore, LEDs, in order to attain a brightness equal even to a small incandescent bulbs, consume considerably more power, lumen for lumen, and there is not much room in flush handle 10 for a hefty battery. It may be possible in time, of course, to incorporate light-emitting means other than filament-based, incandescent bulbs, with results that compare favorably with them both on a cost and efficiency basis.

I claim:

1. An illumination device for a toilet, said toilet comprising a toilet flushing mechanism, said illumination device comprising:

a housing;

a light-emitting element;

a source of electrical energy;

an electrical circuit in communication with said source of electrical energy and
said light emitting element;

a first means of activating said electrical circuit to energize said light emitting element, said first means of activating being actuated by a person;

a second means
of activating said electrical circuit to de-energize said light emitting element, said second means of activating being activated by
the actuation of said first means of activating;

and said housing is adapted to actuate
said toilet flushing mechanism.

2. An illumination device for a toilet, as in claim 1, said toilet further comprising a toilet bowl:

light emitting element illuminating said toilet bowl at least in part;

said light emitting element being de-energized after a predetermined length of time; and said housing is irreversibly connected to said toilet flushing mechanism.

3. An illumination device for a toilet as in claim 1 in which said housing is adapted to transmit torque to said toilet flushing mechanism.

4. An illumination device for a toilet as in claim 2 having means to prevent unwanted activation of said illumination device due to a manipulation of said illumination device.

5. An illumination device for a toilet as in claim 4 in which said second means is a semiconductor circuit comprising a power MOSFET.

6. An illumination device for a toilet as in claim 2 in which said source of electrical energy is a battery.

7. An illumination device for a toilet as in claim 2 in which said light-emitting element is an incandescent bulb.

8. An illumination device for a toilet as in claim 2 in which said light-emitting element is a light emitting diode.

9. An illumination device for a toilet as in claim 2 in which said housing has a front wall and in which said first means is mounted on and extends through said front wall.

10. An illumination device for a toilet as in claim 9 in which said first means is a switch a person must push.

11. An illumination device for a toilet as in claim 10 in which said first means is a membrane switch.

12. An illumination device for a toilet as in claim 11 in which said membrane switch is domed.

13. An illumination device for a toilet as in claim 2 in which said housing has a front wall, and said front wall has a flat, exterior surface, and said light-emitting element is located in an indentation in said flat, exterior surface.

14. An illumination device for a toilet as in claim 13 in which said indentation is located in a corner of said flat, exterior surface.

15. An illumination device for a toilet as in claim 2 in which said housing has a front wall and a bottom wall, and in which said light-emitting element is located in an indentation that involves both said front wall and said bottom wall.

16. An illumination device for a toilet as in claim 13 or claim 15 in which said indentation has an exterior surface, and said exterior surface has a shape substantially congruent to the surface of a cone.

17. An illumination device for a toilet as in claim 16 in which said indentation is covered by a transparent window.

18. An illumination device for a toilet as in claim 1, said toilet further comprising a toilet bowl;

said light emitting element illuminating said toilet bowl at least in part;

said light emitting element being de-energized after a predetermined length of time; and said housing is reversibly connected to said toilet flushing mechanism.

19. An illumination device for a toilet as in claim 18 in which said housing is adapted to transmit torque to said toilet flushing mechanism.

20. An illumination device for a toilet as in claim 18 having means to prevent unwanted activation of said illumination device due to a manipulation of said illumination device.

21. An illumination device for a toilet as in claim 20 in which said second means is a semiconductor circuit comprising a power MOSFET.

22. An illumination device for a toilet as in claim 18 in which said source of electrical energy is a battery.

23. An illumination device for a toilet as in claim 18 in which said light-emitting element is an incandescent bulb.

24. An illumination device for a toilet as in claim 18 in which said light-emitting element is a light emitting diode.

25. An illumination device for a toilet as in claim 18 in which said housing has a front wall and in which said first means is mounted on and extends through said front wall.

26. An illumination device for a toilet as in claim 25 in which said first means is a switch a person must push.

27. An illumination device for a toilet as in claim 25 in which said first means is a membrane switch.

28. An illumination device for a toilet as in claim 27 in which said membrane switch is domed.

29. An illumination device for a toilet as in claim 18 in which said housing has a front wall, and said front wall has a flat, exterior surface, and said light-emitting element is located in an indentation in said flat, exterior surface.

30. An illumination device for a toilet as in claim 29 in which said indentation is located in a corner of said flat, exterior surface.

31. An illumination device for a toilet as in claim 18 in which said housing has a front wall and a bottom wall, and in which said light-emitting element is located in an indentation that involves both said front wall and said bottom wall.

32. A night light An illumination device for a toilet as in claim 29 or claim 31 in which said indentation has an exterior surface, and said exterior surface has a shape substantially congruent to the surface of a cone.

33. An illumination device for a toilet as in claim 32 in which said indentation is covered by a transparent window.

* * * * *

UNITED STATES PATENT AND TRADEMARK OFFICE

CERTIFICATE OF CORRECTION

PATENT NO. : 6,231,203 B1
DATED : May 15, 2001
INVENTOR(S) : Olshausen

It is certified that error appears in the above-identified patent and that said Letters Patent is hereby corrected as shown below:

Column 1,
Line 13, after "however," insert -- , that no outlet is so well -- located, that anight-light plugged --

Column 5,
Line 17, should read -- is shown permanently connected to the other electrical --
Line 23, should read -- which is the functional, but planar, equivalent of the --

Column 6,
Line 64, should read -- volt 0.025 amp incandescent bulb L in the circuit. If the --
Line 67, should read -- 271=(160mAh/25mA) x (3600sec/ 85sec), --

Column 7,
Line 9, should read -- circuit, particularly one employing the 555 timer chip, is --

Column 8,
Line 20, should read -- emitting-element holder 228 is shown placed at a 45° angle --

Column 9,
Lines 24-26, "claim 1" should read -- claim 2 --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,231,203 B1
DATED : May 15, 2001
INVENTOR(S) : Olshausen

It is certified that error appears in the above-identified patent and that said Letters Patent is hereby corrected as shown below:

Column 1,
Line 13, after "however," insert --, that no outlet is so well –located, that anight-light plugged --

Column 5,
Line 17, should read -- is shown permanently connected to the other electrical --
Line 23, should read -- which is the functional, but planar, equivalent of the --

Column 6,
Line 64, should read -- volt 0.025 amp incandescent bulb L in the circuit. If the --
Line 67, should read -- 271=(160mAh/25mA) x (3600sec/ 85sec), Column 7,
Line 9, should read -- circuit, particularly one employing the 555 timer chip, is --

Column 8,
Line 20, should read -- emitting-element holder 228 is shown placed at a 45° angle --

Column 9,
Lines 24-26, "claim 1" should read -- claim 2 --.

Signed and Sealed this

Eighteenth Day of December, 2001

*Attest:*

*Attesting Officer*

JAMES E. ROGAN
*Director of the United States Patent and Trademark Office*